US007708012B2

(12) United States Patent
Shiue

(10) Patent No.: US 7,708,012 B2
(45) Date of Patent: May 4, 2010

(54) DRY TOP SNORKEL HAVING A LOCKING DEVICE TO PREVENT INADVERTANT CLOSURE

(75) Inventor: Chih-Cheng Shiue, Escondido, CA (US)

(73) Assignee: QDS Injection Molding, L.L.C., Escondido, CA (US)

( * ) Notice: Subject to any disclaimer, the term of this patent is extended or adjusted under 35 U.S.C. 154(b) by 865 days.

(21) Appl. No.: 11/584,925

(22) Filed: Oct. 21, 2006

(65) Prior Publication Data

US 2008/0092883 A1 Apr. 24, 2008

(51) Int. Cl.
*B63C 11/16* (2006.01)

(52) U.S. Cl. ..... 128/201.11

(58) Field of Classification Search ..... 128/200.29, 128/201.11, 201.26–201.28, 202.14; D24/110.5; 114/327; 405/185–187
See application file for complete search history.

(56) References Cited

U.S. PATENT DOCUMENTS 2,815,751 A * 12/1957 Ferraro ..... 137/410
5,960,791 A 10/1999 Winefordner et al.
6,371,108 B1 * 4/2002 Christianson ..... 128/201.11
6,904,910 B2 6/2005 Christianson
6,994,085 B2 2/2006 Shiue
7,069,927 B1 * 7/2006 Pan ..... 128/201.11
7,077,127 B2 7/2006 Christianson
7,165,545 B1 * 1/2007 Shiue ..... 128/201.11

* cited by examiner

*Primary Examiner*—Steven O Douglas
*Assistant Examiner*—Kristen C Matter
(74) *Attorney, Agent, or Firm*—Leonard Tachner

(57) ABSTRACT

The improved snorkel dry top has a fulcrum to which a float member and a diaphragm yoke are attached. The fulcrum has a blocking tab that rests in an aperture in the float member attaching hook when the snorkel is above the surface of the surrounding water. The diaphragm yoke cannot rotate the diaphragm when the blocking tab is in the hook aperture. Therefore, even when tilted, the snorkel remains open allowing free flow of air into the snorkel tube. Another significant improvement is the connection of the float member, diaphragm and yoke to the snorkel top's splashguard mask. This improvement assures that the delicate structures of these components are not exposed to potentially destructive impact forces in the event that the splashguard mask is removed from the snorkel tube.

8 Claims, 5 Drawing Sheets

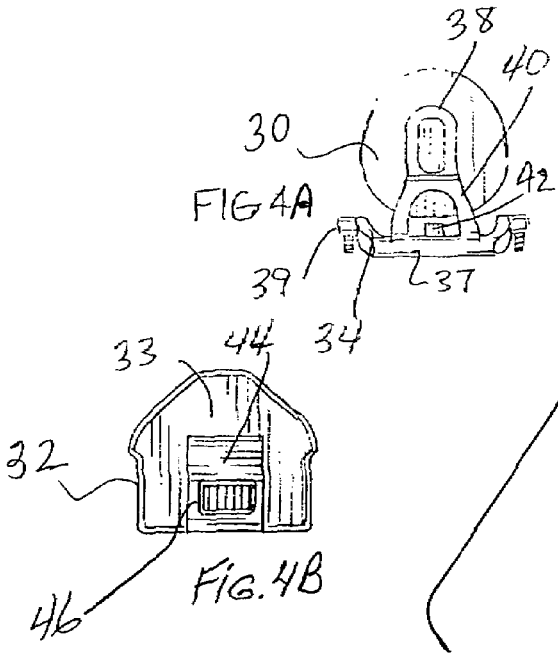
FIG 4A
FIG. 4B
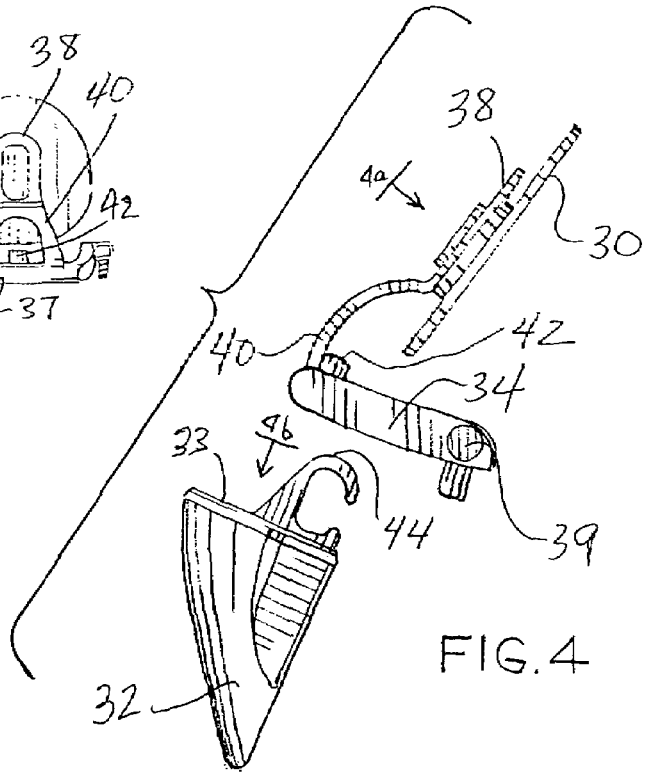
FIG. 4
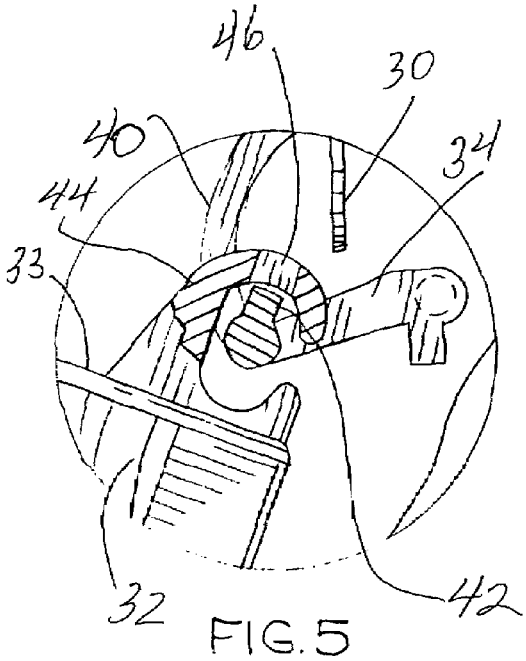
FIG. 5
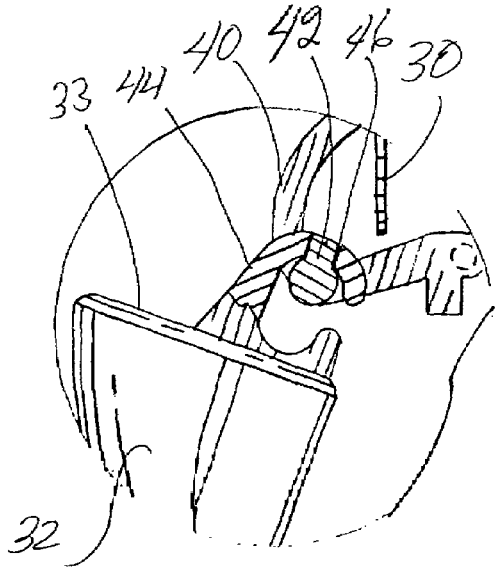
FIG. 6

DRY TOP SNORKEL HAVING A LOCKING DEVICE TO PREVENT INADVERTANT CLOSURE

BACKGROUND OF THE INVENTION

1. Field of the Invention

The present invention relates generally to the field of snorkels and more specifically to an improved dry top for snorkels.

2. Background Art

This invention is an improvement of the snorkel dry top disclosed in issued U.S. Pat. No. 6,994,085 to Chih-Cheng Shiue and assigned to the assignee hereof. Snorkel dry tops comprise devices configured to prevent water from entering the open top of a snorkel tube. Typically they include a rubber-like diaphragm and a float or buoyant device. The diaphragm is positioned in proximity to the top opening for relative movement thereto for opening and closing the opening. Movement of the diaphragm is controlled by the float and its response to whether the water level is sufficiently high on the snorkel to make the float buoyant. When the float is immersed, its buoyancy forces it toward the top opening thereby forcing the diaphragm to close the opening and prevent the entry of water into the snorkel tube. When the float is above the water, gravity forces the float away from the opening, pulling the diaphragm from the opening as well and thereby allowing air to pass freely into and out of the snorkel tube. Some such snorkel dry tops also provide splashguards to resist entry of water droplets while the snorkel top is above the water surface and the diaphragm is pulled away from the opening. Such droplets of water come from splashing waves and the like and can otherwise enter the open top even while the top of the snorkel is above the water surface. One such snorkel dry top is described in U.S. Pat. No. 6,994,085 and includes both a diaphragm and float assembly as well as a splashguard referred to therein as a mask. Other such dry tops are disclosed in issued U.S. Patents such as U.S. Pat. No. 5,960,791 to Winefordner et al and U.S. Pat. Nos. 6,904,910 and 7,077,127 to Christianson.

An inherent problem associated with snorkel dry tops that depend on a combination of buoyancy and gravity is that they're subject to inappropriate operation when they're tilted above the surface. When they're above the surface, gravity should keep the tube top open so that air can pass freely into and out of the snorkel. However, if the top is tilted, the effect of gravity can inadvertently close the opening by forcing the diaphragm against the opening, thereby preventing the free-flow of air into and out of the snorkel tube. Even a rather modest tilting of the snorkel combined with a suction effect of air rushing into the opening while the snorkeler is breathing in, can inadvertently close the opening at an inappropriate time and thereby interfere with normal operation of the snorkel.

Therefore, there is a need to improve such dry top snorkels by configuring them so that they are more likely to stay open while they're above the water surface even when they are tilted.

SUMMARY OF THE INVENTION

The present invention is designed to provide the aforementioned improvement. More specifically, the improved snorkel dry top of the present invention has a fulcrum to which a float member and a diaphragm yoke are attached. The fulcrum has a blocking tab that rests in an aperture in the float member attaching hook when the snorkel is above the surface of the surrounding water. The diaphragm yoke cannot rotate the diaphragm when the blocking tab is in the hook aperture. Therefore, even when tilted, the snorkel uses a unique locking device to remain open allowing free flow of air into the snorkel tube.

Another significant improvement of the preferred embodiment of the present invention is the connection of the float member, diaphragm and yoke to the snorkel top's splashguard mask. This improvement assures that the delicate structures of these components are not exposed to potentially destructive impact forces in the event that the splashguard mask is removed from the snorkel tube. In the improved snorkel dry top of the present invention, when the snorkeler removes the splashguard mask, he or she also removes the float member, diaphragm and yoke at the same time so that the remaining snorkel can be used without a dry top.

BRIEF DESCRIPTION OF THE DRAWINGS

The aforementioned objects and advantages of the present invention, as well as additional objects and advantages thereof, will be more fully understood herein after as a result of a detailed description of a preferred embodiment when taken in conjunction with the following drawings in which:

FIG. 4 is a side view of the diaphragm, yoke and float member;

FIG. 4A is a view of the diaphragm and yoke taken along 4A of FIG. 4;

FIG. 4B is a view of the float member taken along 4B of the FIG. 4;

FIG. 5 is an enlarged view of the yoke and float member interface shown while the float member is subjected primarily to buoyancy forces;

FIG. 6 is an enlarged view similar to that of FIG. 5, but shown while the float member is subjected primarily to gravity;

DETAILED DESCRIPTION OF A PREFERRED EMBODIMENT

Figure 1:
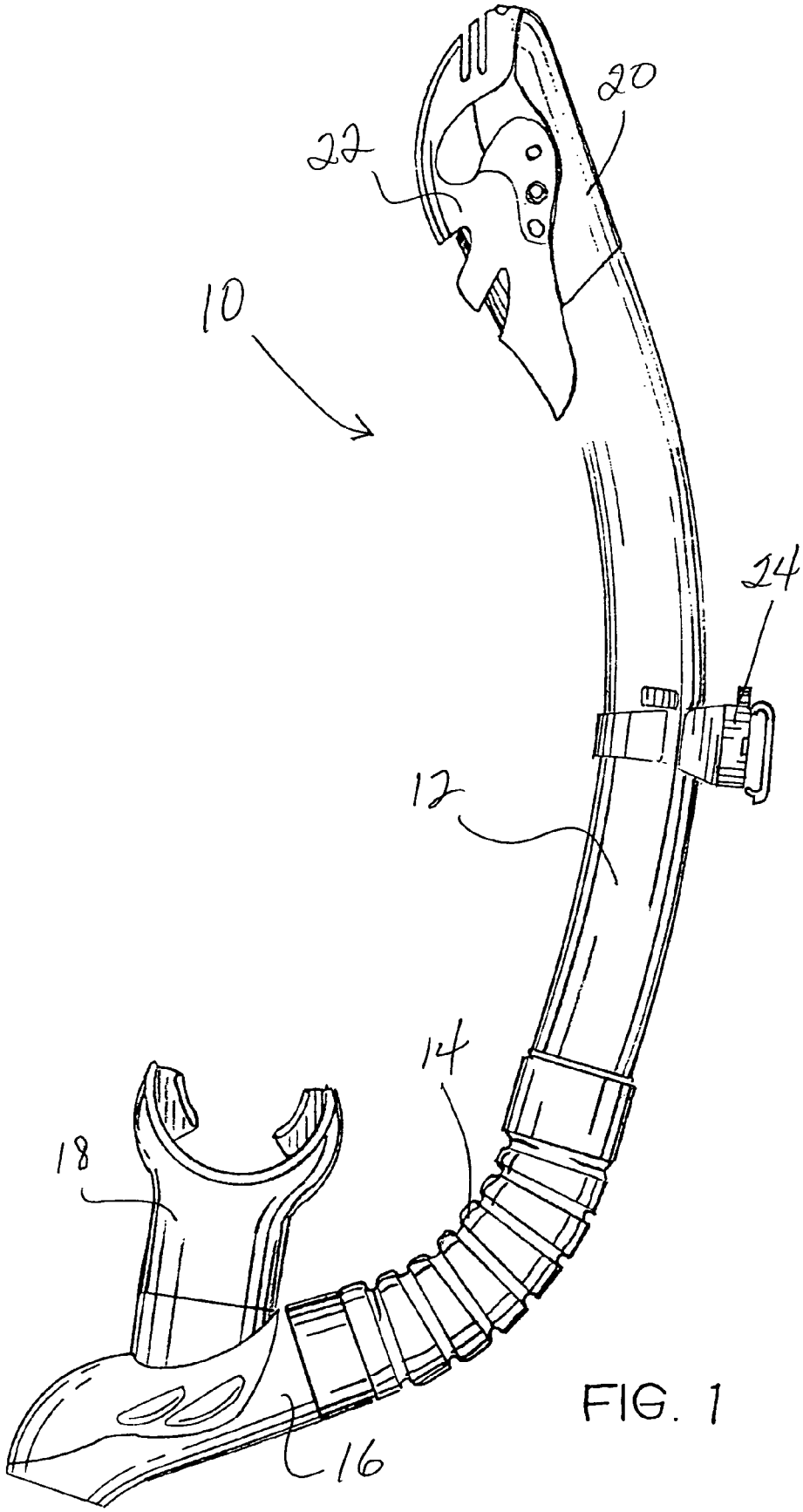
FIG. 1 is a view of a fully assembled snorkel having the improved dry top of the present invention.

Referring to the accompanying drawings, it will be seen that the preferred embodiment of a snorkel 10 in accordance with the principal features of the present invention, comprises a main tube 12, a flexible portion 14, a mouthpiece section 16 and a dry top 20. Mouthpiece section 16 provides a mouthpiece 18 to enable a snorkeler to breath through snorkel 10 as long as the dry top 20 is above the water surface. A dive mask hook 24 allows the snorkel 10 to be secured to a dive or swim mask strap (not shown) as is typical for snorkels. The dry top 20 provides a splashguard 22 which, as will be seen hereinafter, serves the dual functions of resisting entry of splashed water into the top opening of the snorkel and providing a protective connection to critical components of the dry top 20.

Figure 2:
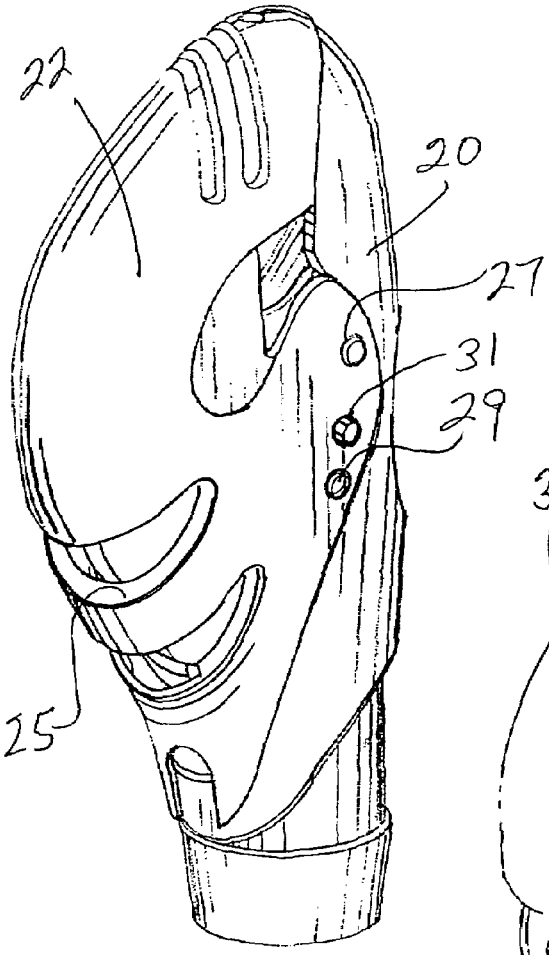
FIG. 2 is an enlarged view of the dry top of the snorkel of FIG. 1.
Figure 3:
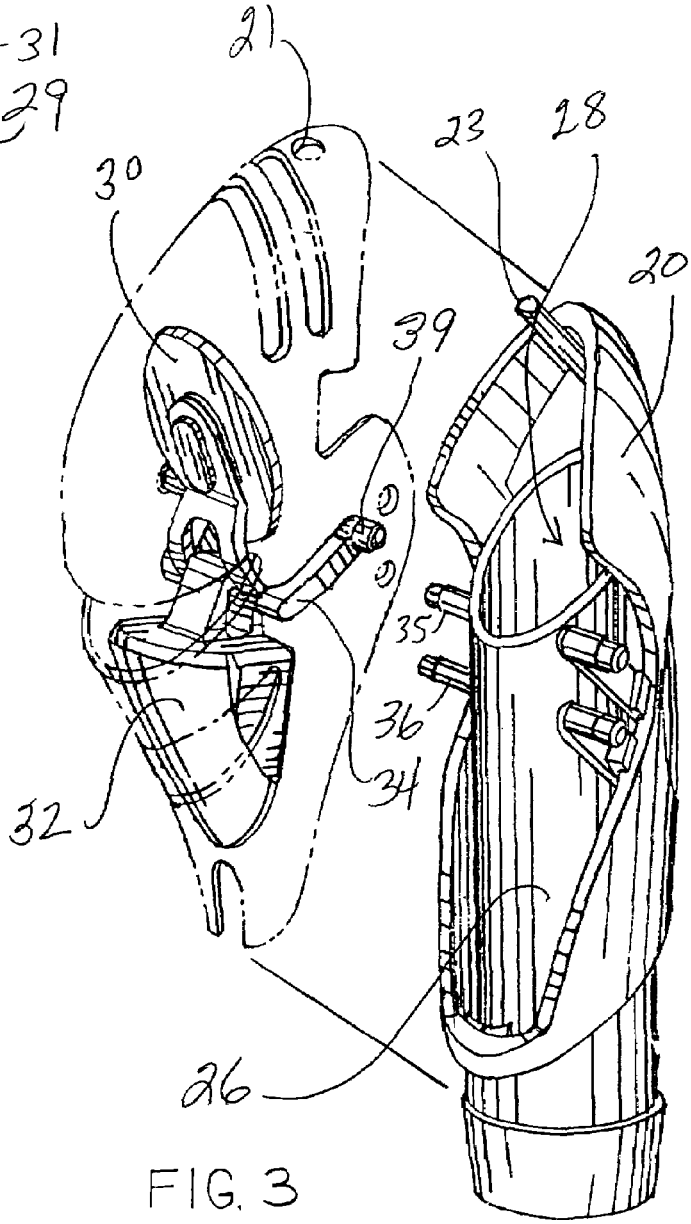
FIG. 3 is an exploded view with the splashguard mask shown in phantom to enable a clearer view of the diaphragm and float member of the preferred embodiment.

As seen best in FIGS. 2 and 3, the dry top 20 including splashguard 22 comprises a diaphragm 30, a yoke 38 and a float member 32, all of which are interconnected at a fulcrum 37. Diaphragm 30, held by yoke 38, is designed to rotate with fulcrum 37 to open and close airflow opening 28 at the end of top tube 26. Fulcrum 37 is controlled by the position of float member 32 depending upon whether the float member is above or below the water surface. If it's above the water surface, gravity causes the float member weight to pull down on the yoke 37 and pull the diaphragm 30 away from opening 28. If it's below the water surface, the buoyancy effect of the water on the float member causes the float member to push up on the yoke and push the diaphragm against the opening. The yoke is elevated through its side members 34 and its axles 39 which are rotatably connected into receptacles 31 of guard 22. The yoke 38 is permanently affixed to the fulcrum 37 while the float member 32 is merely hooked onto the fulcrum 37 so that the float member is free to swing in a limited fashion about the fulcrum.

As also shown in FIGS. 2 and 3, splashguard 22 is configured to releasably mate with the remaining structure of dry top 20. Each side of guard 22 has a pair of receptacles 27 and 29 configured to receive corresponding cylindrical tabs 35 and 36 extending from each side of top tube 26. In addition, the top of guard 22 has a receptacle 21 designed to receive an extending tab 23 above opening 28 on top tube 26 to firmly attach splashguard 22 in the manner shown in FIG. 2. A plurality of louvers 25 permit air to pass through guard 22 on its path through opening 28.

Figure 7:
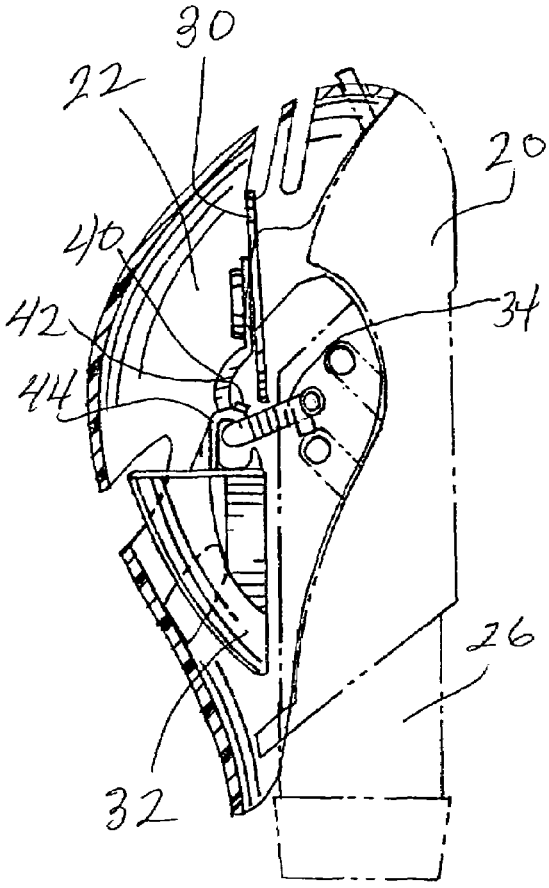
FIG. 7 is a side partially cross-sectioned view of the improved dry top shown oriented straight up.
Figure 8:
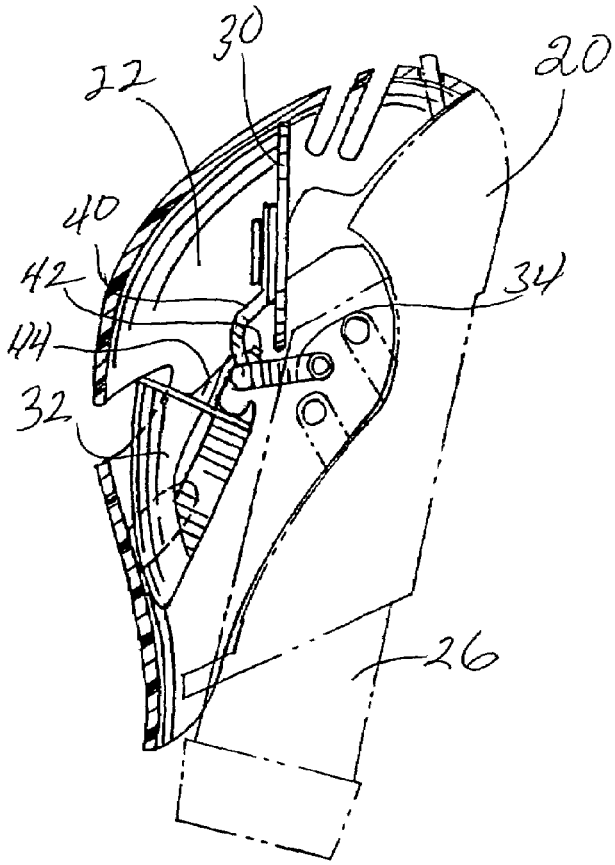
FIG. 8 is a view similar to that of FIG. 7, but showing the improved dry top shown tilted about 15° from vertical.
Figure 9:
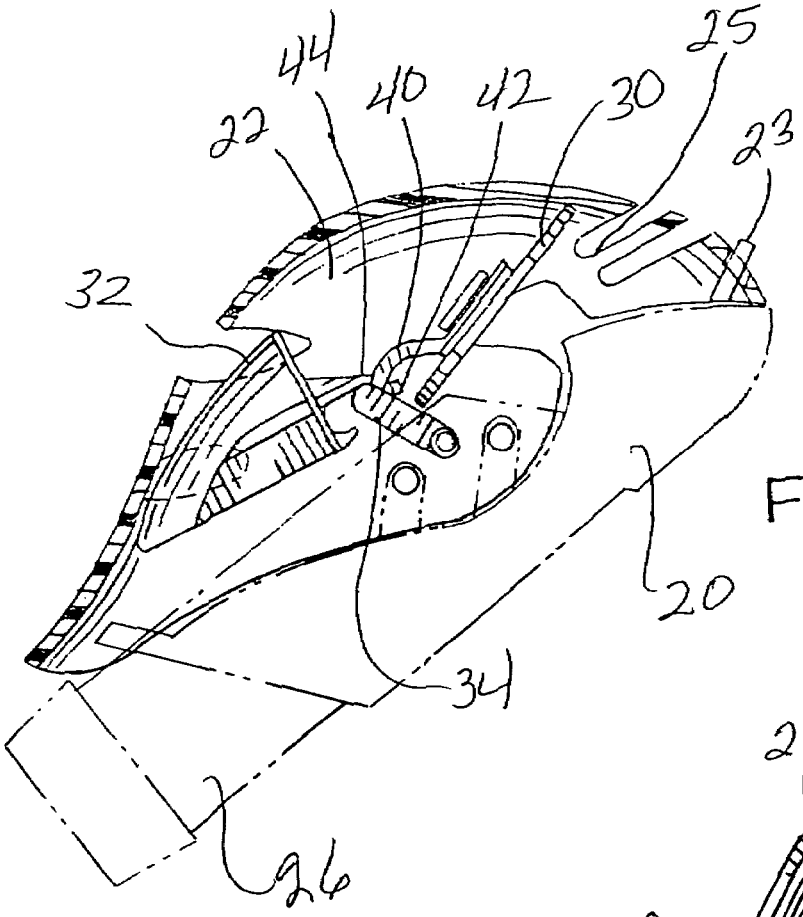
FIG. 9 is a view similar to that of FIG. 7, but showing the improved dry top tilted about 45° from vertical.

Referring now to FIGS. 4, 4A, 4B, 5 and 6, it will be seen that the diaphragm yoke 38 comprises a pair of arches 40 attached at two spaced apart locations along fulcrum 37. At the center of fulcrum 37 and between arches 40, resides a blocking tab 42 extending upwardly therefrom. It will also be seen that extending from the top surface 33 of float member 32 is a hook member 44 having an aperture 46 at the uppermost portion thereof. Aperture 46 has an appropriate shape and size to receive blocking tab 42. When the floating member 32 is buoyant, hook member 44 and blocking tab 42 are disengaged so that diaphragm yoke 38 is free to rotate diaphragm 30 into sealing engagement with opening 28. However, when floating member 32 is not buoyant (i.e., out of the water) hook member 44 engages blocking tab 42 which is then trapped in aperture 46. As shown in FIGS. 7-9, because of the proximity of the float member to the interior surface of the splashguard, it cannot rotate more than a few degrees before contacting that interior surface. Therefore, while blocking tab 42 is trapped in aperture 46, the diaphragm also cannot rotate more than a few degrees before the float member hits the splashguard interior surface. Thus, when the dry top 20 is out of water (i.e., above the water surface) any extent of tilting of snorkel 10 will not permit diaphragm 30 to close the opening 28. Even the 45° tilt shown in FIG. 9 will not produce a closure of the snorkel dry top while it is above the water surface. Therefore, a significant disadvantage of the prior art is overcome by the locking device shown herein.

Figure 10:
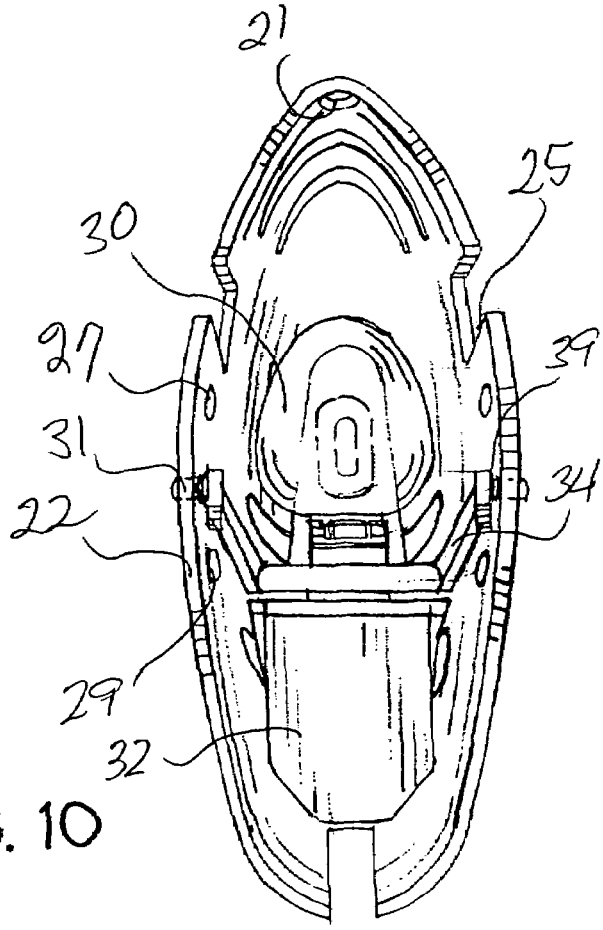
FIG. 10 is a plan view of the splashguard mask interior showing the connected diaphragm, yoke and float member.

Another improvement of the dry top of the present invention is depicted in FIG. 10. More specifically, as shown in FIG. 10, the crucial components of the dry top (i.e., float member, diaphragm, yoke, fulcrum) are connected to the splashguard 22 and not to the top tube 26. This equates to a form of protection of those critical components whenever the splashguard is removed. Therefore, unlike the prior art, there's no easy way to remove the splashguard and gain access to the float member and diaphragm while they're still configured for functional operation in conjunction with the snorkel top tube.

Having therefore disclosed improvements to prior art dry top snorkels, it will now be apparent that various modifications and additions may be made to the described embodiment without deviating from the inventive features of such improvements. Accordingly, the scope hereof is not to be deemed to be limited by the disclosed embodiment, but only by the appended claims and their equivalents.

I claim:

1. An improved snorkel having a dry top wherein a diaphragm an a float member cooperate to close the snorkel to prevent water entry when the float member is below the surface of the surrounding water and to open the snorkel to permit air flow into and out of the snorkel when the float member is above the surface of surrounding water; the improvement comprising:

a locking device responsive to the position of said float member relative to said water surface for substantially locking said diaphragm to said float member only when said float member is above said water surface to prevent inadvertent closing of said snorkel caused by a tilting of said snorkel.

2. The improvement recited in claim 1 wherein said locking device comprises:

a hook member having an aperture, said hook member being affixed to said float member; and a blocking tab acting in connection with said diaphragm for movement therewith;

said blocking tab being received in said hook member aperture only when said float member is above said water surface.

3. The improvement recited in claim 2 wherein said diaphragm is connected to a yoke member having a fulcrum, and wherein opening and closing of said snorkel is dependent upon the angle of elevation of said diaphragm, said yoke member and said fulcrum acting in combination as a unitary member.

4. The improvement recited in claim 3 wherein said blocking tab extends from said fulcrum and wherein said hook member rotatably engages said fulcrum adjacent said blocking tab.

5. The improvement recited in claim 4 said snorkel having an elongated tube, said tube having an opening at one end and a mouthpiece at another end for the flow of breathing air between said opening and said mouthpiece within said tube, and wherein said float member is positioned for movement along said tube adjacent said opening for controlling whether or not said diaphragm closes said opening.

6. The improvement recited in claim 5 further comprising a splash guard releasably connected to said tube adjacent said opening; said diaphragm, said yoke member and said float member being connected to said splash guard.

7. The improvement recited in claim 6 wherein said diaphragm, said yoke member and said float member have no direct connection to said snorkel tube.

8. A method of preventing inadvertent closure of a dry top snorkel, the snorkel having an air opening, a diaphragm and a float member cooperating to close the snorkel air opening to prevent water entry when the float member is below the surface of surrounding water and to pen the snorkel air opening to permit air flow into and out of the snorkel when the float member is above the surface of surrounding water; the method comprising the steps of:

a) positioning the diaphragm for angular motion toward and away from the air opening of the snorkel;

b) controlling the angular motion of the diaphragm according to the location of the float member relative to the snorkel air opening;

c) permitting the float member to move relative to the snorkel air opening depending upon whether the float member is immersed in water or above the water; and d) locking the diaphragm to the float member only while the float member is above the water.

* * * * *